United States Patent [19]

Lown

[11] Patent Number: 4,695,224

[45] Date of Patent: Sep. 22, 1987

[54] CENTRIFUGAL COMPRESSOR WITH INJECTION OF A VAPORIZABLE LIQUID

[75] Inventor: Harold Lown, Schenectady, N.Y.

[73] Assignee: General Electric Company, Schenectady, N.Y.

[21] Appl. No.: 734,941

[22] Filed: May 16, 1985

Related U.S. Application Data

[63] Continuation-in-part of Ser. No. 637,925, Aug. 6, 1984, abandoned, which is a continuation of Ser. No. 336,733, Jan. 4, 1982, abandoned.

[51] Int. Cl.[4] ..... F04D 29/58

[52] U.S. Cl. ..... 415/116; 415/175; 60/728

[58] Field of Search ..... 415/115, 116, 117, 175, 415/176, 199.1, 199.2, 199.3; 60/728, 649, 39.53, 39.58, 39.59

[56] References Cited

U.S. PATENT DOCUMENTS

| | | | |
|---|---|---|---|
| 2,786,626 | 3/1957 | Redcay | 415/116 |
| 2,819,838 | 1/1958 | Warner | 415/116 |
| 3,145,915 | 8/1964 | Marchal et al. | 415/115 |

*Primary Examiner*—Abraham Hershkovitz
*Assistant Examiner*—John Kwon
*Attorney, Agent, or Firm*—William H. Steinberg; James C. Davis, Jr.; Paul R. Webb, II

[57] ABSTRACT

An assembly for producing wet compression of gas being compressed in a centrifugal-type, multistage gas compressor having an impeller, a diffuser "downstream" of the impeller, and a cross-over channel connected to the downstream end of the diffuser includes a plurality of liquid jets for injecting a vaporizable liquid such as water into a gas stream undergoing compression. The liquid jets are positioned axisymmetrically about the longitudinal axis of the compressor shaft and are adapted to inject liquid into the diffuser substantially upstream of the cross-over channel, and, in a preferred embodiment, have a radial spacing from such axis of about 1.05 to 1.1 times the maximum radius of the compressor impeller. The invention attains a marked increase in vaporization of the injected liquid, providing better compressor performance and reduced wear of compressor internal parts.

7 Claims, 4 Drawing Figures

CENTRIFUGAL COMPRESSOR WITH INJECTION OF A VAPORIZABLE LIQUID

This application is a continuation of application Ser. No. 637,925, filed Aug. 6, 1984, which is a continuation Ser. No. 336,733, filed Jan. 4, 1982, both abandoned.

TECHNICAL FIELD

The present invention relates generally to systems for increasing the efficiency of centrifugal-type gas compressors, and, in particular, to an assembly for injecting a vaporizable liquid such as water directly into the gas stream of a centrifugal, multistage compressor.

BACKGROUND ART

Centrifugal gas compressors have long been employed for many purposes, including applications as diverse as jet engines and heat pumps. Previous developments relating to centrifugal gas compressors have shown that the injection of vaporizable liquid into the gas stream of the compressor to achieve wet compression, or compression involving vaporization of the injected liquid, as opposed to dry compression, is particularly advantageous. This is because vaporization of injected liquid in the compressor reduces the inlet temperature of the compressor stage downstream of the liquid injection point, thereby resulting in a significant increase in compression ratio, or ratio of output gas pressure to input gas pressure, for little or no increase in power supplied to the compressor. Additionally, the operating temperature of the compressor may be effectively reduced by direct water injection, thereby eliminating the need for expensive external intercoolers.

Although the benefits obtained by injecting vaporizable liquid directly into the gas stream of a centrifugal compressor are widely recognized, the devices and techniques known to the prior art for providing wet compression have posed some distinct disadvantages. A reference typifying such prior art is U.S. Pat. No. 2,786,626 to Redcay. Redcay discloses a process for the compression of gas in a multistage compressor wherein vaporizable liquid is injected into the compressor inlet and is also injected into the cross-over channel of each of the first several compressor stages. The liquid injected into the cross-over channels is injected through liquid jets, only one per stage, oriented upstream of the gas stream of the compressor.

The compressor of Redcay suffers from achieving a rather limited degree of vaporization of the liquid injected into the compressor gas stream. This is because the liquid is injected into a low velocity region of the compressor and thus the breaking up or atomizing of the liquid into very small droplets is not achieved. This is particularly so in regard to the liquid injected into the compressor inlet. Very small droplets are necessary to achieve a high degree of vaporization because the surface area of such a droplet is large relative to the volume of the droplet, and the droplet can thus readily absorb heat and vaporize. The limited vaporization of the injected liquid in the Redcay compressor results in a limited reduction in power required for his compressor. The limited vaporization also results in large liquid droplets impinging on internal compressor parts, such as the impeller, thus posing a definite risk of serious erosion and pitting of these parts after a relatively short period of operation.

If it is desired to inject liquid from the jets of Redcay into the compressor gas stream an adequate distance to attain a reasonable degree of atomization thereof, his compressor would suffer from requiring complex apparatus for injecting the liquid into the gas stream at high velocity. Such high velocity is necessary, owing to the fact that his liquid jets are oriented against the direction of flow of the gas stream.

OBJECTS OF THE INVENTION

Accordingly, it is an object of the present invention to provide an assembly for use in a centrifugal-type multistage compressor for the direct injection of vaporizable liquid into the gas stream of the compressor which results in increased vaporization of the injected liquid.

It is another object of the present invention to provide an assembly for use in a centrifugal-type multistage compressor for the direct injection of a vaporizable liquid into the compressor gas stream which results in an enhanced reduction in power required for the compressor.

It is yet another object of the present invention to provide an assembly for use in a centrifugal-type multistage compressor for the direct injection of vaporizable liquid into the gas stream of the compressor which results in reduced pitting and erosion of internal compressor parts.

It is an additional object of the present invention to provide an assembly for use in a centrifugal-type multistage compressor for the direct injection of vaporizable liquid into the compressor gas stream which does not require complex apparatus for injecting the liquid at high velocity into the gas stream.

Other objects and advantages will be apparent from an examination of the following description and the appended claims and drawings.

SUMMARY OF THE INVENTION

In accordance with the aforesaid objects, the invention provides a compressor including a housing, a rotatable shaft journaled within the housing, and a plurality of successive compressor stages positioned along the longitudinal axis of the rotatable shaft. At least one of the compressor stages includes a multi-bladed impeller rotatable with the rotatable shaft, a diffuser adapted to receive a stream of gas from the impeller, a cross-over channel adapted to receive the stream of gas from the diffuser and liquid injection means for injecting vaporizable liquid into the gas stream. The liquid injection means is adapted to inject liquid into the diffuser substantially upstream of the cross-over channel. The vaporizable liquid is forcefully shattered or atomized, thereby producing very small liquid droplets which readily vaporize.

BRIEF DESCRIPTION OF THE DRAWING FIGURES

The features of the invention believed to be novel are set forth with particularity in the appended claims. The invention itself, however, both as to organization and method of operation, together with further objects and advantages thereof, may best be understood by references to the following description taken in conjunction with the accompanying drawing figures in which:

FIG. 1 is a simplified, cross-sectional view of a portion of a conventional centrifugal-type multistage compressor incorporating the present invention;

FIG. is a detail view of a portion of a first stage of the multistage compressor shown in FIG. 1;

FIG. 3 is a graph illustrating the vaporization rate of liquid droplets versus the radial spacing of liquid jets of the compressor shown in FIG. 1; and FIG. 4 is view taken at line 4—4 in FIG. 1, partially broken away at the upper portion thereof, illustrating details of the third stage of the compressor of FIG. 1.

DETAILED DESCRIPTION OF THE INVENTION

Figure 1:
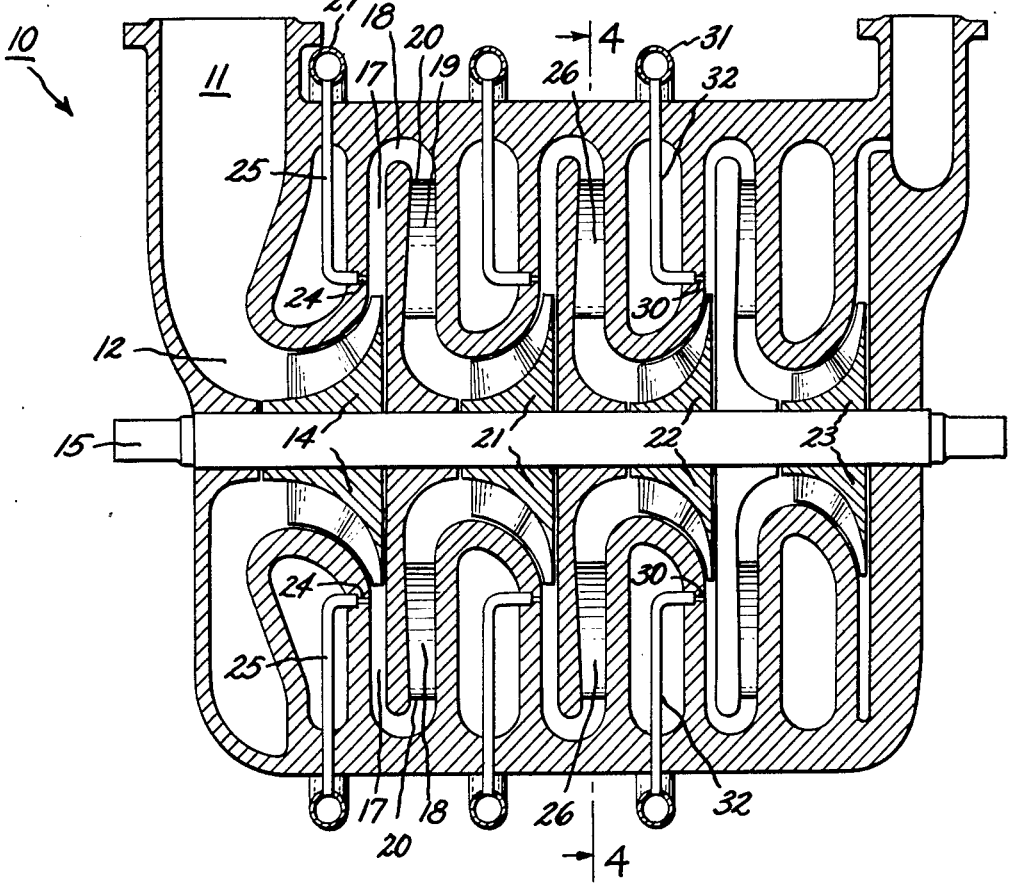

FIG. 1 illustrates a conventional centrifugal-type four-stage compressor, indicated generally at 10, although the present invention can be effectively employed in a compressor having a larger or smaller number of stages. The compressor 10 is shown in simplified form with stationary parts (for example, the compressor housing) cross-hatched one way and rotatable parts cross-hatched the other way. Gas to be compressed enters the compressor 10 through an inlet 11 and travels in a stream through a passage 12 into a first multibladed impeller 14 attached to a rotatable shaft 15. As is known, the high rotational velocity of the impeller 14 directs the gas from the impeller 14 centrifugally into a diffuser 17, which preferably is of the vaneless type, and which is described more fully below. The gas stream being compressed passes through a cross-over channel 18, and thence through a return channel 19, which typically is provided with directional control vanes, such as at 20, for directing the gas stream into a further multi-bladed impeller 21, representing a second stage of the four-stage compressor 10. Likewise, still further multi-bladed impellers 22 and 23, representing third and fourth stages of the compressor 10, respectively, are provided. The second and third stages of the compressor 10 incorporate, and benefit from, the invention in substantially the same way as the first stage. Thus, an understanding of any of the first, second, or third stages will yield an understanding of the first through third stages. Considering, now, only the first compressor stage including the impeller 14, the present invention provides a plurality of liquid jets 24, preferably comprising water jets, which are connected to a supply of liquid via supply tubes 25, each of which, in turn, is connected, for example, to a distribution supply pipe 27, which, in turn, is connected to a liquid delivery means (not illustrated). Each of the plurality of liquid jets 24 is adapted to inject liquid into the diffuser 17 substantially upstream of the cross-over channel 18. By "substantially upstream" as used herein is meant a distance at least as high as about 20 percent of the difference between the maximum radius of the diffuser 17 (discussed below) and the maximum radius of the impeller 14.

Figure 2:
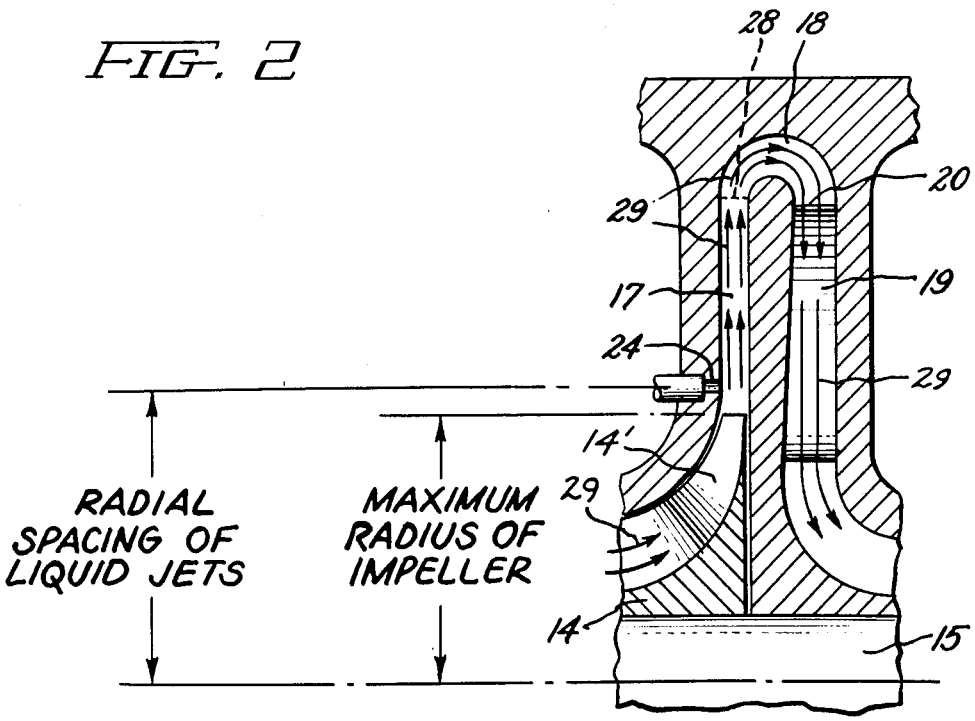

The significance of injecting liquid into the diffuser 17 substantially upstream of the cross-over channel 18 can be better appreciated from considering FIG. 2, which is a detail view of the upper portion of the first stage of the multistage compressor 10 as depicted in FIG. 1. As is well known in the art, a "diffuser" is so shaped as to have the capability of converting dynamic pressure, or kinetic energy, into static pressure. As such, the dividing line between the diffuser 17 and the cross-over channel 18, representing the maximum radius of the diffuser 17, is approximately as shown by the dashed line 28. The diffuser 17 is a radial diffuser; that is, the available space within the diffuser 17 increases with increasing radial distance from the axis of the rotatable shaft 15. As indicated by the arrows 29, a gas stream undergoing compression in the compressor 10 is directed from left to right through the blading 14' of the impeller 14, through the diffuser 17, through the cross-over channel 18, and through the directional control vanes 20 of the return channel 19. Since the diffuser 17 is a radial diffuser, and the impeller 14 ejects the gas stream 29 into the diffuser 17 with a high rotational velocity, the gas stream 29 actually follows a spiral path in the diffuser 17 and return channel 19, although this is not immediately apparent from FIG. 2, considered by itself. The gas stream 29 is moving at its highest velocity when it leaves the impeller 14, and then slows down rapidly as it proceeds radially in the diffuser 17 due to conservation of angular momentum. By having the liquid jets 24 radially spaced in the diffuser 17 substantially upstream of the cross-over channel 18, that is, in a region of relatively high velocity of the gas stream 29, significant advantages are attained.

Figure 3:
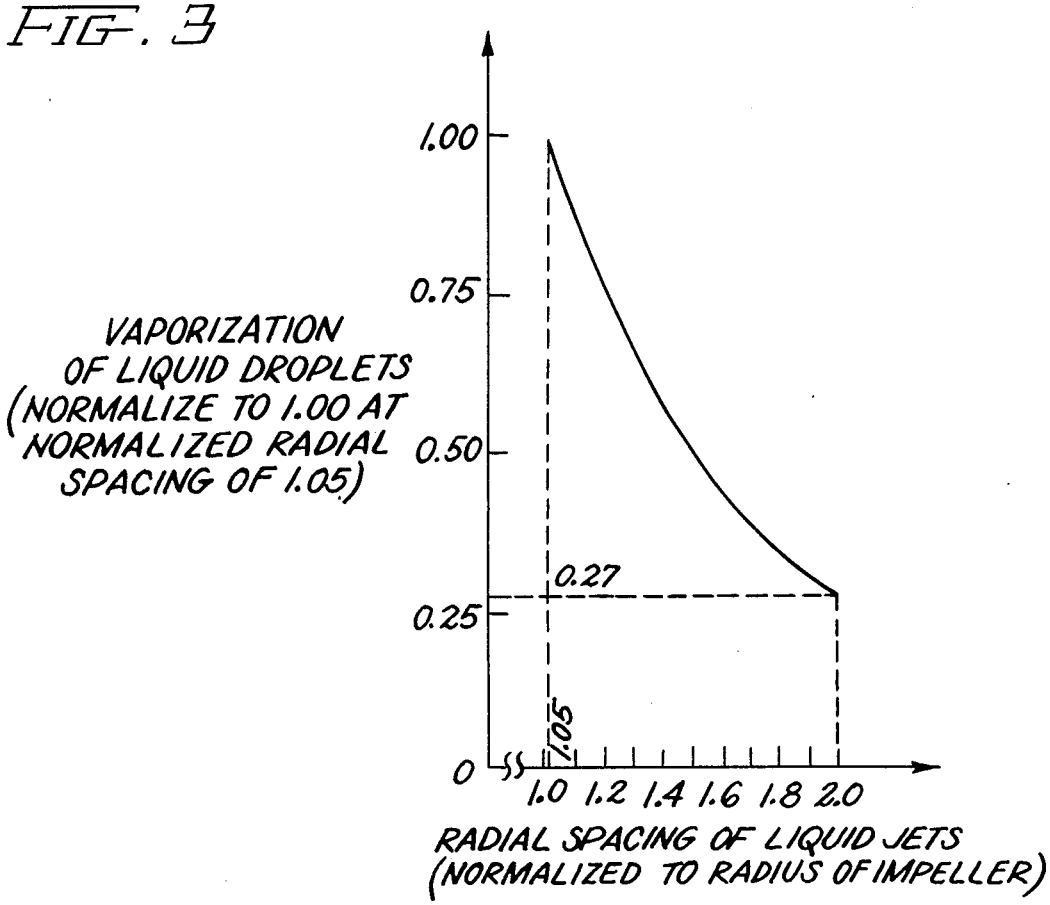

For example, the stream of liquid injected by the plurality of jets 24 into the gas stream 29 are forcefully shattered or atomized into extremely fine droplets. As noted above, the smaller a droplet is, the more readily it can absorb heat and vaporize. In fact, the rate of vaporization, to a fair degree of approximation, directly depends upon the smallness of a droplet (that is the inverse of droplet diameter). The smallness of a droplet, in turn, is related to the relative velocity between a droplet and the gas stream 29; that is, the smallness depends upon the exponential square of such relative velocity. Since the relative velocity primarily depends on the velocity of the gas stream 29, the velocity of injected liquid being low in comparison, and the velocity of the gas stream 29 varies according to the inverse of the radial spacing of the liquid jets 24, the relation between the smallness of a droplet, and, hence, the vaporization rate thereof, and the radial spacing of the liquid jets 24, can be illustrated graphically as in FIG. 3.

Not only does the invention provide an increased rate of vaporization, it also significantly increases the duration of vaporization, whereby an additional assurance of thorough vaporization is attained. The increased duration of vaporization is due to the long, spiral path that liquid droplets in the gas stream 29 (FIG. 2) must travel in their journey from their point of injection at the jets 24 to the next stage of the compressor 10. Thus, two factors work together to markedly improve overall vaporization at the low radial spacing of the liquid jets 24 in accordance with the present invention: (1) atomizing injected liquid into extremely fine droplets, thereby strikingly increasing their vaporization rate (see FIG. 3); and, (2) significantly increasing the duration, or "residence time", of droplets in the gas stream 29 (FIG. 2).

The markedly superior vaporization attained by the invention has important consequences for compressor 10 performance and durability. There is a significant enhancement in the reduction of power supplied to the compressor 10, and the temperature of the gas stream 29 is desirably held down. The internal parts of the compressor 10, such as the multi-bladed impellers 21, 22, and 23 can now be exposed to practically zero risk of pitting and eroding due to high velocity, unvaporized liquid droplets impacting against them.

A further advantage of having the liquid jets 24 radially spaced in the diffuser 17 substantially upstream of the cross-over channel 18 is the incremental pressure gain achieved for the compressor stage due to a momentum change associated with heat extraction from, or desuperheating of, liquid droplets moving at high velocity. Such desuperheating increases with increased liquid vaporization rate and increased velocity, both of which occur at low radial spacing of the liquid jets 24. The attainable incremental pressure gain is believed to amount to at least 2 or 3 percent of the compressor stage pressure gain in the absence of desuperheating.

As discovered by the present inventor, the radial spacing of the plurality of liquid jets 24 should be above about 1.05 times the maximum radius of the impeller 14; otherwise instabilities will occur in the gas stream 29 issuing from the impeller 14.

Referring again to FIG. 2, another aspect of the invention is illustrated. The liquid jets 24 are oriented normally or prependicularly to the gas stream 29. This enables the liquid supplied to the jets 24 to be injected into the gas stream 29 with a low velocity, for example, 50 feet per second, because the injected liquid is directed crosswise through the gas stream 29. The injected liquid can thus readily penetrate through the gas stream 29 to provide an optimal degree of atomization; however, the injected liquid should not be allowed to impact on the righ-hand wall of the diffuser 17 or else poor atomization thereof would occur. Since only a low velocity flow of liquid needs to be injected through the liquid jets 24 when they are oriented normally to the gas stream 29, the liquid delivery means (not shown), for injecting liquid can be simple in construction. This benefit will still be realized with a tolerance in the orientation of the jets 24 of about 10 degrees from normal to the gas stream 29.

Figure 4:
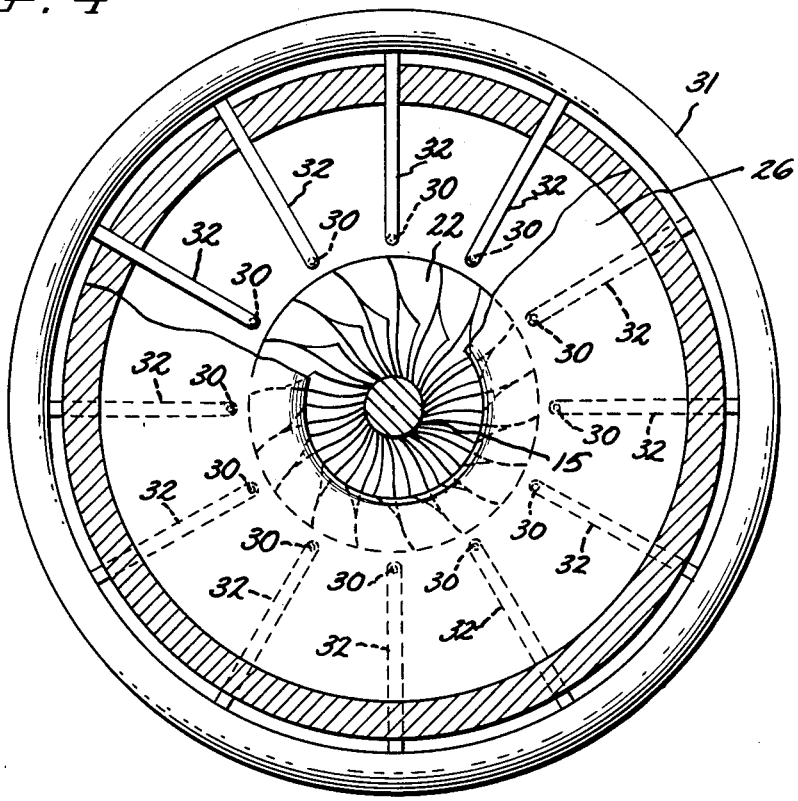

Referring now to FIG. 4, a further aspect of the invention is illustrated. FIG. 4 is a view taken at line 4—4 in FIG. 1, is partially broken away to expose the supply tubes 32 and location of liquid jets 30, and is simplified by omission of the vanes of return channel 26. Such further aspect of the invention is illustrated in FIG. 4 with respect to the third stage of the compressor 10, which includes the impeller 22. This further inventive aspect involves the number and positioning of a plurality of liquid jets 30 (corresponding to the plurality of jets 24 of the first compressor stage), which are connected to a liquid delivery means (not shown) through a distribution pipe 31 via supply tubes 32. The plurality of jets 30 preferably numbers between 6 and 12, with 8 contemplated in the best mode of practicing the invention. The jets 30 are preferably disposed axisymmetrically about the longitudinal axis of the shaft 15. The foregoing number and positioning of the plurality of jets 30 makes full use of the available gas stream in the compressor 10 for vaporizing liquid droplets.

More or fewer liquid jets than the preferred numbers of liquid jets just described can be used in the invention. An upper limit on the number of liquid jets is imposed by reduced diameters of the bores thereof, which are likely to become clogged by contaminants in the liquid injected through them. A lower number of jets than lowest preferred number (that is, 6) will result in less than full use of the available gas stream in the compressor 10 for vaporizing liquid droplets, although benefits are still attained.

In the best mode contemplated for practicing the invention, the compressor 10 comprises an industrial process heat pump wherein the vaporizable liquid injected into the gas stream in the compressor comprises water and the radial spacing of the liquid jets 24 in the range of about 1.05 to 1.1 times the maximum radius of the impeller 14 is preferred, with the upper end of this range being particularly preferred. This range is based on a compressor having a pressure ratio per stage in the range from about 1.4 to 1.6 and having an impeller tip speed per stage in the range from about 900 to 1100 feet per second. However, the beneficial effects of the invention are attained at radial spacings of the liquid jets 24 above the foregoing 1.05 to 1.1 range, provided that the compressor stage is operating with impeller tip speeds considerably higher than the foregoing tip speeds.

Such heat pump attains an increased coefficient of performance, not only owing to improved vaporization of injected water in the heat pump, but also owing to the increased mass flow of steam in the heat pump output.

While only certain preferred features of the invention have been shown by way of illustration, many modifications and changes will occur to those skilled in the art. For example, the centrifugal-type compressor 10 could be combined with an axial-type compressor. It is, therefore, to be understood that the appended claims are intended to cover the foregoing and all such modifications and changes as fall within the true spirit and scope of the invention.

What is claimed as my invention and desired to be secured by Letters Patent of the United States is:

1. A compressor including a housing, a rotatable shaft journaled within said housing, and a plurality of successive compressor stages positioned along the longitudinal axis of said rotatable shaft, with at least one of said compressor stages comprising:

a multi-blade impeller rotatable with said rotatable shaft;

a diffuser adapted to receive a stream of gas from said impeller;

a cross-over channel adapted to receive the gas stream from said diffuser; and liquid injection means for injecting vaporizable liquid into the gas stream in said diffuser at a high relative velocity with respect to said gas stream, substantially upstream of said cross-over channel adjacent to said impeller said liquid injection means being stationary relative to said impeller, so that said vaporizable liquid is shattered into droplets by said gas stream from said impeller, and so that said droplets are vaporized in said diffuser, wherein each of said liquid jets is oriented with respect to within a tolerance of about 10 degrees of normal to the gas stream in said diffuser, wherein each of said liquid jets is spaced radially with respect to said axis at a radius in the range of about 1.05 to 1.1 times the maximum radius of said impeller.

2. The compressor of claim 1 wherein said liquid jets are disposed approximately axisymmetrically about said axis.

3. The compressor of claim 1 or claim 2 wherein said plurality of liquid jets comprises from 6 to 12 liquid jets.

4. The compressor of claim 1 wherein said liquid jets are spaced radially with respect to said axis so that liquid injected therethrough into the gas stream becomes substantially completely vaporized before encountering the impeller of a further compressor stage.

5. The compressor of claim 2 wherein said plurality of liquid jets comprises 8 liquid jets.

6. The compressor of claim 5 wherein each of said liquid jets is spaced radially with respect to said axis at a radius of about 1.1 times the maximum radius of said impeller.

7. The compressor of claim 1 wherein said liquid jets are adapted to carry water.

* * * * *